United States Patent [19]

Anders

[11] Patent Number: 4,526,241

[45] Date of Patent: Jul. 2, 1985

[54] ADJUSTABLE LENGTH DRILLING SUB

[75] Inventor: Edward O. Anders, Houston, Tex.

[73] Assignee: Dailey Petroleum Services Corp., Conroe, Tex.

[21] Appl. No.: 498,744

[22] Filed: May 27, 1983

Related U.S. Application Data

[63] Continuation-in-part of Ser. No. 294,497, Aug. 24, 1981, Pat. No. 4,440,241, which is a continuation-in-part of Ser. No. 19,175, Mar. 9, 1979, abandoned.

[51] Int. Cl.[3] ..... F21B 7/08

[52] U.S. Cl. ..... 175/76; 175/321; 285/303

[58] Field of Search ..... 175/76, 61, 325, 321, 175/322, 74; 285/302, 303, 404; 464/18, 19, 162, 163, 183

[56] References Cited

U.S. PATENT DOCUMENTS

| | | | |
|---|---|---|---|
| 2,167,194 | 7/1939 | Anderson | 255/1 |
| 2,684,835 | 7/1954 | Moore | 255/28 |
| 2,712,920 | 7/1955 | Cullen et al. | 175/321 |
| 2,748,261 | 5/1956 | Wolar | 285/303 X |
| 2,805,840 | 9/1957 | Thompson | 175/76 |
| 2,819,040 | 1/1958 | James et al. | 255/1.6 |
| 2,829,864 | 4/1958 | Knapp | 255/1.6 |
| 2,918,259 | 12/1959 | Le Bus, Sr. | 255/28 |
| 2,919,900 | 1/1960 | Segelhorst | 255/28 |
| 3,042,125 | 7/1962 | Duncan | 175/73 |
| 3,088,532 | 5/1963 | Kellner | 175/230 |
| 3,098,667 | 7/1963 | Greenwood | 285/376 |
| 3,235,017 | 2/1966 | Lynes | 175/321 |
| 3,354,950 | 11/1967 | Hyde | 166/5 |
| 3,572,450 | 3/1971 | Thompson | 175/76 |
| 3,581,834 | 6/1971 | Kellner et al. | 175/321 |
| 3,667,556 | 6/1972 | Henderson | 175/73 |
| 3,743,034 | 7/1973 | Bradley | 175/61 |
| 3,815,692 | 6/1974 | Varley | 175/65 |
| 3,878,903 | 4/1975 | Cherrington | 175/45 |
| 3,884,051 | 5/1975 | Bottoms | 64/23.7 |
| 3,961,674 | 6/1976 | Craig, Jr. et al. | 175/325 |
| 3,974,886 | 8/1976 | Blake, Jr. | 175/76 |
| 4,015,673 | 4/1977 | Craig, Jr. et al. | 175/61 |
| 4,046,279 | 9/1977 | Rosler | 285/303 X |
| 4,076,084 | 2/1978 | Tighe | 175/73 |
| 4,108,256 | 8/1978 | Moore | 175/61 |
| 4,135,577 | 1/1979 | Nelson et al. | 166/241 |
| 4,220,214 | 9/1980 | Benoit | 175/61 |
| 4,291,773 | 9/1981 | Evans | 175/61 |
| 4,394,881 | 7/1983 | Shirley | 175/76 |

OTHER PUBLICATIONS

Bowen Tools, Inc. 1982–1983 Catalog, pp. 1293–1299.
Behavior of Multiple-Stabilizer Bottom-Hole Assemblies, Keith Millheim, Oil and Gas Journal, Jan. 1, 1979.
Here are Basics of Bottom-Hole Assembly Mechanics, Oil and Gas Journal, Dec. 4, 1978.
Single-Stabilizer Behavior Described, Keith Millheim, Oil and Gas Journal, Dec. 18, 1978.

*Primary Examiner*—James A. Leppink
*Assistant Examiner*—Thuy M. Bui
*Attorney, Agent, or Firm*—Arnold, White & Durkee

[57] ABSTRACT

An adjustable length drilling sub is disclosed for placing in a drill string between stabilizers to allow the distance between the stabilizers to be changed while the drill string is in the well bore to adjust the rate the angle of the well bore from the vertical is changing. The sub includes an outer member and an inner member that extends into the outer member with an annular space between the members. Protrusions in the form of drive pins mounted in the wall of the outer member extend into the annular space to move into and out of engagement with cavities formed on the outer surface of the inner member. When the pins are in engagement with the cavities, torque in one direction and weight can be transmitted to the bit. When the pins are rotated in the other direction out of the cavities, the members can be moved longitudinally relative to each other to change the distance between the stabilizers.

10 Claims, 5 Drawing Figures

Figure 1:
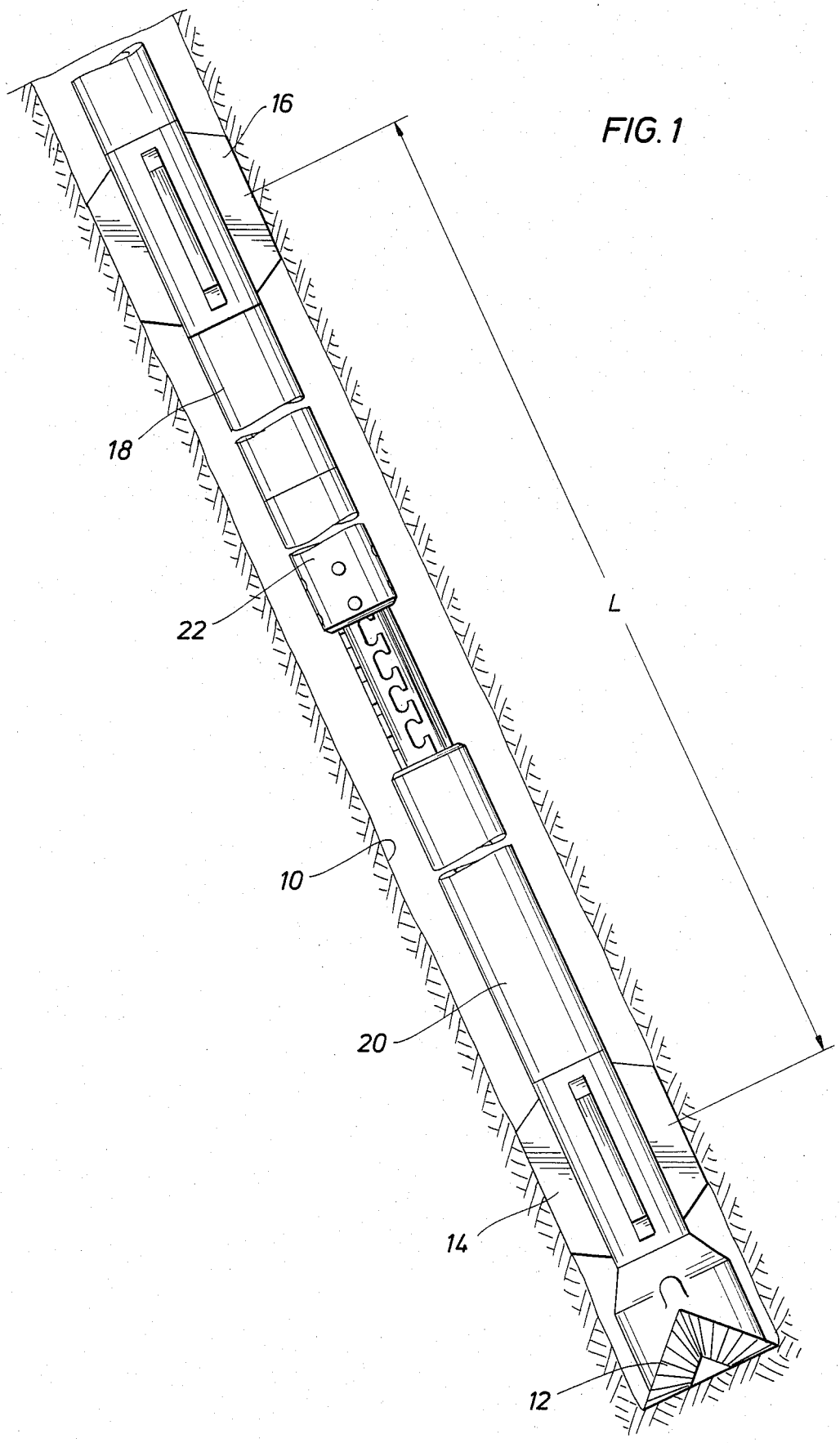

FIG. 2C
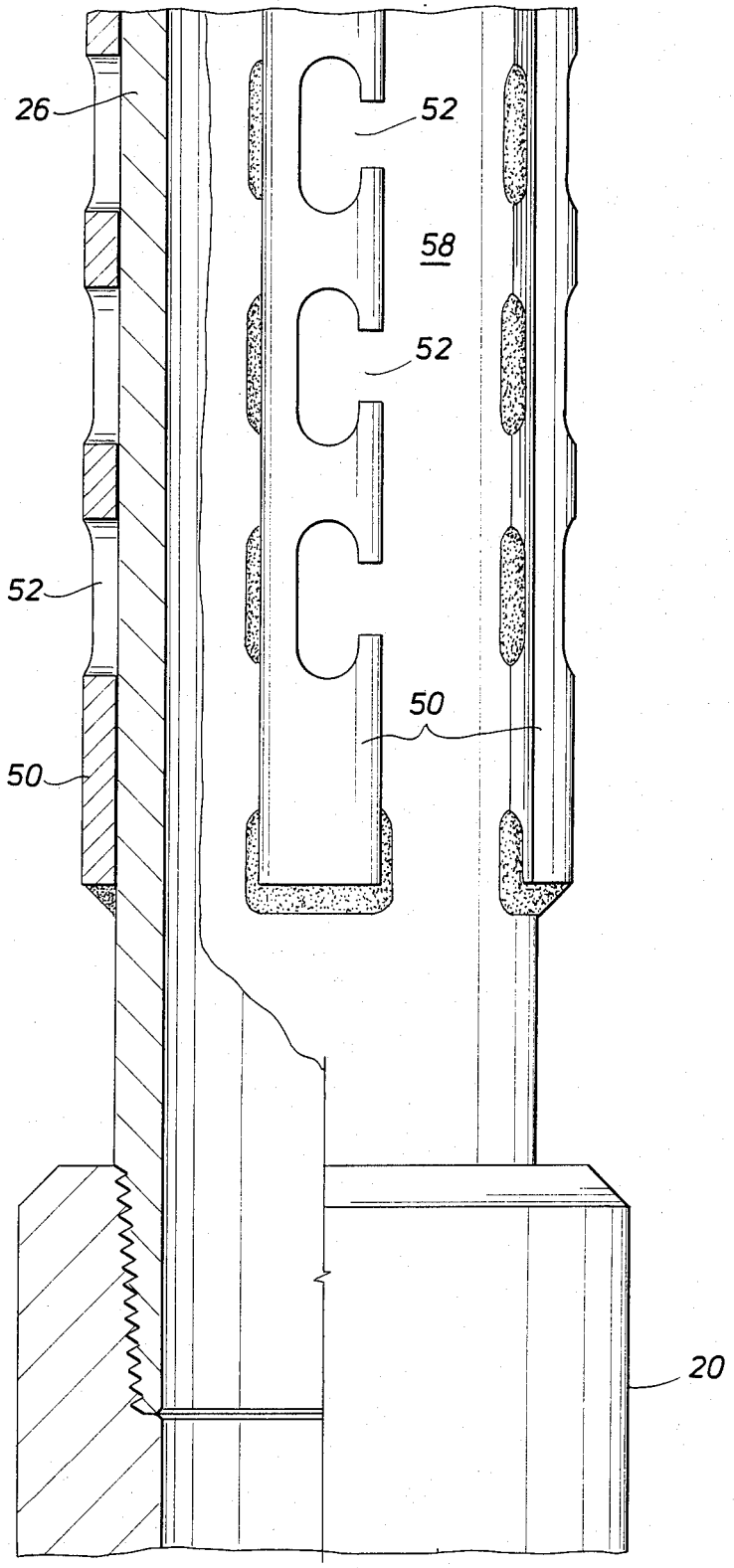
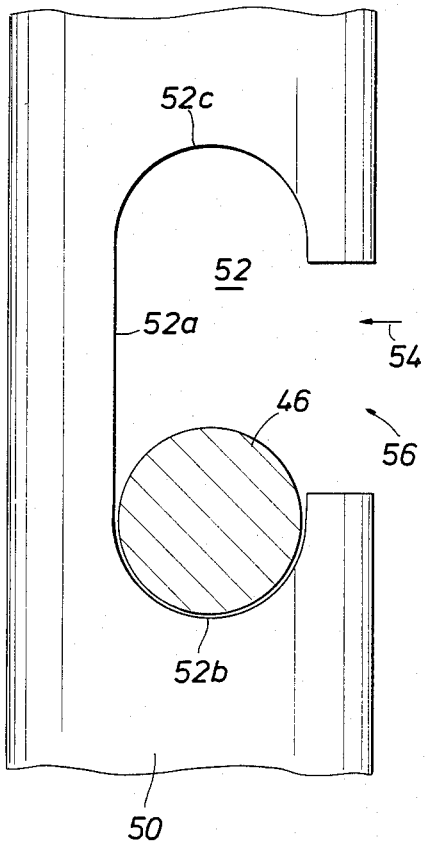
FIG. 3

ADJUSTABLE LENGTH DRILLING SUB

This application is a continuation-in-part of co-pending application Ser. No. 294,497, filed Aug. 24, 1981, now U.S. Pat. No. 4,440,241, issued Apr. 3, 1984, which was a continuation-in-part of application Ser. No. 019,175, filed Mar. 9, 1979, and now abandoned.

This invention relates, generally to drilling well bores that are inclined from the vertical and, in particular, to controlling the rate of change of the inclination of the well bore as it is being drilled.

It is known that the rate of increase in the inclination of a well bore, usually measured in degrees per hundred feet, can be controlled to a great extent by placing a stabilizer near the bit and another stabilizer in the drill string above the near bit stabilizer a predetermined distance. Calculations can then be made based upon the distance between the stabilizers, the buoyant effect of the mud, the weight of the drill collars, the weight to be run on the bit, and the inclination of the well bore to obtain a reasonably good indication of the rate the bit will increase the angle of the well bore from the vertical, i.e., the rate the bit will build angle. This results because the drill collars bend between the stabilizers due to the force of gravity and the axial compressive load placed on the drill collars to provide the weight on the bit. The easiest variable of this group to control accurately is the distance between the stabilizers. Weight on the bit can, of course, be adjusted but this may mean sacrificing rate of penetration which is undesirable. Based on these calculations, the bottom hole assembly is made up with the stabilizers at the desired spacing and drilling proceeds.

Quite often, however, the rate the bit builds angle under actual drilling conditions turns out to be something different from what it was expected from the calculations. When this happens, the directional driller has several options. He can adjust the weight on the bit. If it is reduced, the rate of penetration is reduced, which means wasted time. Or he can remove the bottom hole assembly and adjust the spacing of the stabilizers which means a substantial loss of time and often the pulling of a bit before it has served its useful life. Neither of these options are desirable.

Therefore, it is an object of this invention to provide an adjustable drilling sub for placing in the drill collar section of the drill string between the near bit stabilizer and the first string stabilizer that will allow the distance between the stabilizers to be adjusted without having to pull the drill string from the well bore.

It is a further object of this invention to provide an adjustable drilling sub for placing in the drill string between two stabilizers to allow the distance between the stabilizers to be adjusted, while the drill string is in the well bore and that will transmit torque and weight on the bit as if it was a solid member in the drill string.

It is a further object of this invention to provide such a drilling sub that consists of two telescoping annular members with one of the members having a plurality of protrusions extending into the annular space between the members and the other having a plurality of cavities to receive the protrusions on the other member to hold the members against relative rotation and relative longitudinal movement when the protrusions are in engagement with the cavities to allow torque and weight to be transmitted to the drill bit, when the members are rotated in one direction, and to move the protrusions out of engagement with the cavities when the members are rotated relatively in the other direction to allow the length of the sub to be adjusted.

These and other objects, advantages, and features of this invention will be apparent to those skilled in the art from a consideration of this specification, including the attached drawings and appended claims.

Figure 2A:
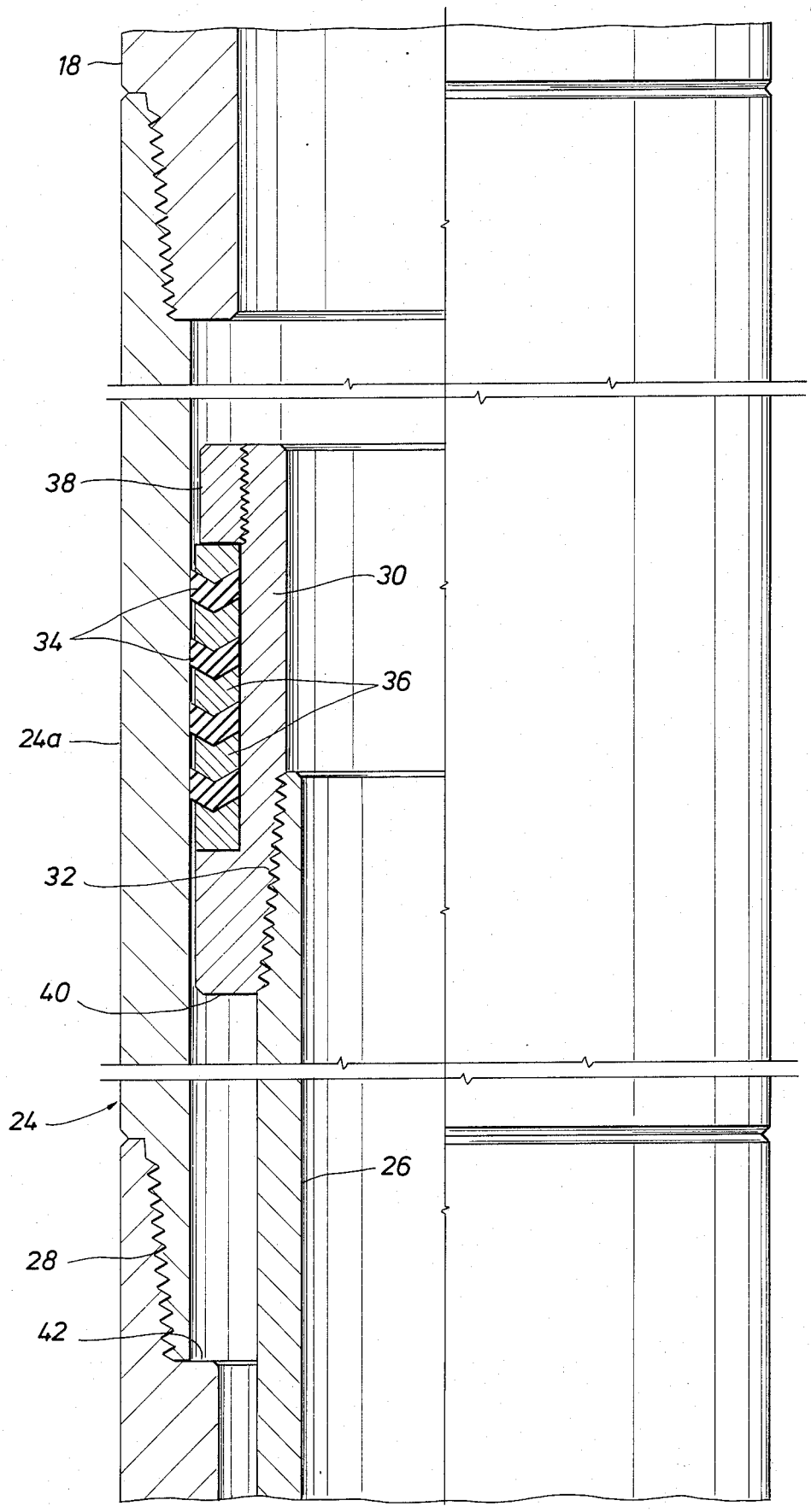
Figure 2B:
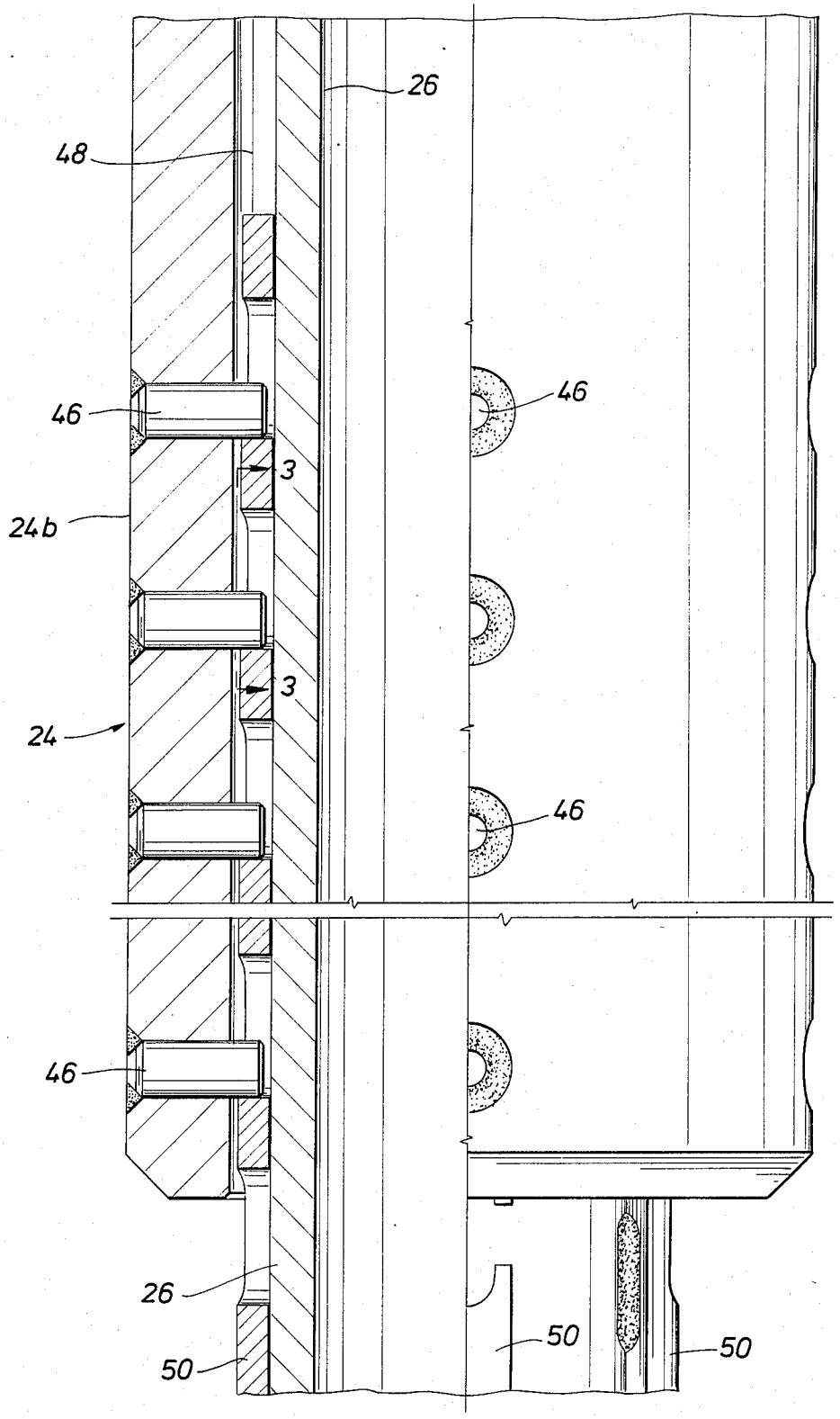

In the drawings:

FIG. 1 is a view, partly in elevation and partly in section, of a drilling assembly that includes the adjustable drilling sub of this invention in an inclined well bore;

FIGS. 2A, 2B, and 2C are views, partly in section and partly in elevation, of the preferred embodiment of the adjustable drilling sub of this invention; and FIG. 3 is a view on an enlarged scale taken along 3—3 of FIG. 2B.

In FIG. 1 a typical drilling assembly is shown in inclined well bore 10. It includes drilling bit 12, shown in engagement with the bottom of the well bore, near bit stabilizer 14, first string stabilizer 16, spaced from the near bit stabilizer by drill collars 18 and 20 and the adjustable length sub 22 of this invention. As stated above, the rate that drill bit 12 will increase the inclination of well bore 10 will depend upon some known and preselected factors and some that are unknown. The known factors are the inclination of the well bore, the weight that is intended to be run on the drilling bit, the weight of the drill collar assembly, the density of the drilling mud, and the length, L, between near bit stabilizer 14 and first string stabilizer 16. From this can be calculated the angle the drill bit will tend to make with the bottom of the well bore that will tend to increase or build the angle the well bore makes with the vertical. Some unknown factors that can't be predetermined accurately is the gage of the well bore where the stabilizers will be located. If the hole at the stabilizers is substantially in gage, as tends to be the case when drilling through hard consolidated formations, the stabilizers will tend to resist the bending of the drill collars between the stabilizers and thereby tend to reduce the rate the bit builds angle. On the other hand, if the hole is out of gage, as frequently happens in less consolidated formations, the ability of the stabilizers to resist the effect of the bending of the drill collars is reduced and the rate the bit builds angle is generally increased. Knowing the formations through which he is drilling allows the directional driller to anticipate such conditions and make allowances for them.

As stated above, it is an object of this invention to provide an adjustable length drilling sub to be connected into the drill string between the near bit stabilizer and the first string stabilizer to allow the distance, "L", between the stabilizers to be adjusted to change the rate that the drill bit builds angle as required to keep the bit drilling along the intended path of the well bore.

Such an adjustable length drilling sub is shown in FIGS. 2A, 2B, and 2C. It includes outer annular member 24 and inner tubular member 26 that extends into and is in telescoping relationship with the outer member. Outer member 24 is made up in two sections 24*a* and 24*b* for ease in manufacture and assembly. The two sections are connected together by threads 28. The upper end of inner member 26 extends into the bore of section 24*a* of the outer member and is connected to wash pipe 30 through threaded connection 32. The wash pipe carries on its outer annular surface packing rings 34 that are spaced apart by spacer rings 36. The packing and space rings are held in place on the outer surface of wash pipe 30 by gland nut 38. Packing rings 34 prevent drilling fluid being pumped down to the bit through the adjustable sub from escaping to the annulus. The wash pipe also provides downwardly facing shoulder 40 that can engage upwardly facing shoulder 42 on the upper end of section **24*b* of the outer member to make sure that the inner member is not inadvertently dropped into the hole when, as will be explained below, the two members are rotated to a position allowing relative longitudinal movement between the two members. The distance between shoulders 40 and 42** should be sufficient to allow the sub to be adjusted in length over the full stroke of the tool.

In accordance with this invention, one of the members is provided with protrusions that extend into the annular space between the members and other member is provided with cavities to receive the protrusions and to limit relative rotation and relative axial movement between the members when the protrusions are located in the cavities and to allow relative longitudinal movement of the members when the protrusions are not located in the cavities. In the embodiment shown, lower section **24*b* (FIG. 2B) has a plurality of drive pins 46 that extend through holes in the wall of section 24*b* of the outer member into annular space 48 between the outer member and inner member 26**. The drive pins are welded in place.

Cavities to receive the protrusions, which in this case are drive pins 46, are provided on the outer surface of inner member 26 by elongated strips 50. The strips are welded in place on inner member 26, as shown in FIG. 2C, in spaced parallel, positions. They have to be spaced angularly the same as are pins 46, which in this case is 90°. Therefore, there will be four rows of pins 46 and four strips 50 also spaced 90° apart.

Since most drilling strings used have right hand threads and the bit is consequently rotated to the right, the cavities are designed to transmit right hand rotation from the drill string to the drill bit. The relative positions of a drive pin and a cavity is shown in FIG. 3. Drive pin 46 is in cavity 52 in engagement with side wall **52*a* to transmit torque in the direction of arrow 54 that will cause the inner member to rotate to the right. Being in contact with curved lower end wall 52*b***, the pin is in position to transmit downward force provided by the weight of the drill collars above it to the drill bit.

Generally, when the drilling assembly is made up at the surface, the preselected distance between the stabilizers will locate the drive pins about midway between the upper and lower limits of the stroke of the drilling sub. Going in the hole, the weight of the drill collars below the sub along with the bit and near bit stabilizer will be supported on drive pins 46 in engagement with upper end arcuate surface **52*c* of cavity 52. Both end surfaces are curved to have the same rate of curvature as the pin to provide good solid engagement between the pin and the end surfaces. The drive pin should generally stay in the cavity selected. Should the bit encounter a bridge as it is being lowered into the well bore, it will simply cause pin 46 to move downwardly into engagement with lower end surface 52*b* till the bridge can be drilled out or broken through. At that time, the pin will move upwardly into engagement with upper end surface 52*c*** and continue to support the portion of the drilling assembly hanging below. The same movement of the pins between the lower and upper end surfaces of the cavities will occur when a connection is made.

After the bit reaches bottom and drilling has proceeded for awhile, if the directional driller begins to see an increase or decrease in rate of build angle that could create a problem, he can recalculate the distance L that he should have to provide the desired build angle. Knowing this, he can either then shorten or lengthen the adjustable length sub by raising the outer member with the drill string and the drill bit resting on the bottom until drive pins 46 are positioned laterally of opening 56 of cavity 52. Slight left hand rotation will then move drive pins 46 into space 58 between metal strips 50 in which the cavities are located. This space is best seen in FIG. 2C. The length between the stabilizers can then be adjusted by either raising or lowering the drill string the desired distance. The pipe string is then rotated to the right causing drive pins 46 to move back into cavities 52. The pins may not be exactly in position to enter openings 56 and it may require some slight adjustment in the position of the drill string to move the pins into the cavities. Once this is done, drilling can be commenced with the new spacing between the stabilizers. The process may repeated if the desired build angle is not obtained.

To assemble the drilling sub, inner member 26 without wash pipe 30 is moved through section **24*b* of the outer member, with drive pins 46 positioned to move along elongated longitudinal spaces 58 between metal strips 50, until the upper end of the inner member is extending above section 24*b*. The wash pipe is then made up on the upper end of the inner member, the packing and gland nut is installed, and upper section 24*a*** of the outer member is connected to the lower section. At this time, the sub can be made up in the drill string.

From the foregoing, it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth or shown in the accompanying drawings is to be interpreted as illustrative and not in a limiting sense.

What is claimed is:

1. An adjustable length drilling sub for connecting into a drilling string between stabilizers to enable the distance between the stabilizers to be adjusted without removing the pipe string from the well bore, comprising an outer member and an inner member in telescoping relationship with an annular space between the members, said members having threads on opposite sides to connect the members into a drilling string between stabilizers with one member connected to the upper portion of the drilling string and the other to the lower portion, protuberance means on one of the members extending into the annular space between the members toward the adjacent surface of the other member, means on the adjacent surface of the other member providing a cavity configured to receive the protuberance means when the members are rotated relative to each other in one direction and to hold the members from further rotation relative to each other in said one direction and limited axial movement to enable torque in said one direction and weight to be transmitted from one member to the other, and to allow said members to move axially relative to each other when the members are rotated relative to each other in the opposite direction to move the protuberance means out of engagement with the cavity means.

2. The adjustable length drilling sub of claim 1 in which the protuberance means include a plurality of pins mounted in the side wall of one of said members and extending into the annular space with their free ends adjacent the side wall of the other member and in which the cavity has an opening in the side through which a pin can move into the cavity when the pin carrying member is rotated relative to the cavity in one direction, said cavity having an end wall shaped like the pin to engage the pin and allow longitudinal force to be transmitted from one member to the other and a side wall to hold the pin from further rotation relative to the cavity to allow torque to be transmitted between the members in said one direction.

3. The drilling sub of claim 2 in which the cavity has another opposite end wall to allow the pin to move from one end of the cavity to the other to transmit longitudinal force up or down the drilling string.

4. The drilling sub of claim 2 in which the cavity means includes an elongated narrow plate extending longitudinally along the surface of said member and attached thereto, said plate having a plurality of longitudinally spaced cavities opening laterally to one side of the plate to allow the pins mounted on the other member to enter the cavities when the members are rotated relative to each other in one direction to stop further rotation relative to each other in said direction so that torque can be transmitted between the members in said direction and to limit longitudinal movement of the members relative to each other to allow force to be transmitted longitudinally between the members in at least one longitudinal direction.

5. A directional drilling apparatus for stepwise adjustment of the length of a tubular drilling string between two longitudinally spaced stabilizers, comprising:

a. a drill string;

b. a lower stabilizer and an upper stabilizer positioned in the drill string;

c. an assembly of two tubular members in longitudinally telescoping relationship to each other, a first one of the tubular members being attached at one end of the assembly to an upper portion of the drill string intermediate the stabilizers and a second one of the tubular members being attached at the opposite end of the assembly to a lower portion of the drill string intermediate the stabilizers; and d. means for transmitting torsional and longitudinal forces between the first and second tubular members at different longitudinal positions of the first tubular member relative to the second tubular member.

6. The directional drilling apparatus of claim 5, wherein:

a. the first and second tubular members are rotatable in relation to each other about their common longitudinal axis; and b. the transmitting means comprises releasable interengaging means on at least one of the tubular members operable at a plurality of longitudinally spaced telescoped positions of the assembly to interlock the members in co-rotatable, longitudinally rigid relation.

7. The directional drilling apparatus of claim 6, wherein:

a. the tubular members define an annular space therebetween; and b. the releasable interengaging means comprises:

1. a raised surface on one of the tubular members protruding into the annular space and extending in a longitudinal direction along the one member, the raised surface defining a plurality of longitudinally arranged and equally spaced cavities, each cavity having a side entrance facing in a common direction; and 2. a plurality of protuberances on the other tubular member protruding into the annular space and arranged longitudinally along the other member, the protuberances having a spacing equal to that of the cavities, each protuberance sized to enter the side entrance of any of the cavities when the protuberance is laterally adjacent the entrance, the protuberances entering the cavities by rotating the tubular members relative to each other.

8. A directional drilling apparatus for connecting into a drilling string comprising:

a. a pair of longitudinally spaced stabilizers;

b. an assembly of two tubular members in longitudinally telescoping relationship to each other, a first one of the tubular members being attached at one end of the assembly to an upper portion of the drill string intermediate the stabilizers and a second one of the tubular members being attached at the opposite end of the assembly to a lower portion of the drill string intermediate the stabilizers; and c. means for transmitting torsional and longitudinal forces between the first and second tubular members at different longitudinal positions of the first tubular member relative to the second tubular member.

9. The directional drilling apparatus of claim 8, wherein:

a. the first and second tubular members are rotatable in relation to each other about their common longitudinal axis; and b. the transmitting means comprises releasable interengaging means on at least one of the tubular members operable at a plurality of longitudinally spaced telescoped positions of the assembly to interlock the members in co-rotatable, longitudinally rigid relation.

10. An adjustable length drilling sub for connecting into a drilling string between stabilizers to enable the distance between the stabilizers to be adjusted without removing the pipe string from the well bore, comprising:

a. an outer tubular member and an inner tubular member in longitudinally telescoping relationship with an annular space between the members, the members being threaded on opposite ends to connect into the drilling string between the stabilizers;

b. a plurality of longitudinally arranged and equally spaced protuberances on one of the members extending in longitudinal alignment into the annular space between the members toward the adjacent surface of the other member; and c. a raised portion on the adjacent surface of the other member defining a plurality of correspondingly longitudinally arranged and equally spaced cavities, each cavity being elongated along the longitudinal axis of the tubular members and having a side entrance adapted to receive one of the protuberances, each cavity configured to enable one of the protuberances to move a limited distance along the cavity when within the cavity upon relative longitudinal movement between the members.

* * * * *